US007763148B2

(12) United States Patent
Reuter et al.

(10) Patent No.: US 7,763,148 B2
(45) Date of Patent: Jul. 27, 2010

(54) METHOD AND APPARATUS FOR PRODUCING A FIBROUS WEB

(75) Inventors: Jörg Reuter, Heidenheim (DE); Thomas Jaschinski, Heidenheim (DE)

(73) Assignee: Voith Patent GmbH, Heindenheim (DE)

( * ) Notice: Subject to any disclaimer, the term of this patent is extended or adjusted under 35 U.S.C. 154(b) by 491 days.

(21) Appl. No.: 11/553,636

(22) Filed: Oct. 27, 2006

(65) Prior Publication Data

US 2007/0095495 A1 May 3, 2007

(30) Foreign Application Priority Data

Oct. 28, 2005 (DE) ..... 10 2005 051 656

(51) Int. Cl.
*D21F 1/08* (2006.01)
*D21F 7/06* (2006.01)
*D21F 11/00* (2006.01)
*D21G 9/00* (2006.01)

(52) U.S. Cl. ..... 162/198; 162/DIG. 11; 700/128; 700/129

(58) Field of Classification Search ..... 162/198, 162/189–190, 252, 253, 258, 259, 263, DIG. 10, 162/DIG. 11; 700/127–129
See application file for complete search history.

(56) References Cited

U.S. PATENT DOCUMENTS 3,619,360 A * 11/1971 Persik, Jr., ..... 162/258
3,981,767 A * 9/1976 Al-Shaikh ..... 162/198
5,674,364 A * 10/1997 Pitkajarvi ..... 162/216
5,707,495 A * 1/1998 Heinzmann et al. ..... 162/343
5,746,889 A * 5/1998 Huovila et al. ..... 162/216
5,814,191 A * 9/1998 Huovila ..... 162/216
5,843,281 A * 12/1998 Huovila ..... 162/216
5,885,420 A * 3/1999 Heinzmann et al. ..... 162/198
5,900,121 A * 5/1999 Lehleiter et al. ..... 162/322
5,944,957 A * 8/1999 Fagerlund et al. ..... 162/258
6,086,716 A * 7/2000 Watson et al. ..... 162/198
6,113,741 A 9/2000 Kettunen et al. ..... 162/158
6,258,213 B1 * 7/2001 Fagerlund et al. ..... 162/198
6,299,731 B1 10/2001 Begemann et al. ..... 162/216
6,328,851 B1 * 12/2001 Huhtelin et al. ..... 162/198
6,368,461 B1 * 4/2002 Ruf et al. ..... 162/258
6,493,601 B1 * 12/2002 Wells et al. ..... 700/128

(Continued)

FOREIGN PATENT DOCUMENTS

EP 1 028 191 8/2000

(Continued)

*Primary Examiner*—José A Fortuna
(74) *Attorney, Agent, or Firm*—Taylor & Aust, P.C.

(57) ABSTRACT

Disclosed is a method for producing a fibrous web, in particular a paper web, paperboard web or tissue web, with which a material flow of higher consistency and a material flow of lower consistency are mixed in a variable ratio over the machine width and the mixed flow is fed via a headbox as a headbox stream to a mesh section, whereby the mixing ratio between these two material flows of different consistency in the respective mixed flow acts as the set-point variable for controlling the gsm substance of the fibrous web over the machine width. In this case the ratio between the fibrous material content and the filler material content in the material flow of lower consistency is established or controlled such that the filler material fraction in the fibrous web can be established or controlled at least essentially independently of the gsm substance.

16 Claims, 6 Drawing Sheets

U.S. PATENT DOCUMENTS

| | | | | |
|---|---|---|---|---|
| 6,517,680 | B1 * | 2/2003 | Fredlund et al. | 162/198 |
| 6,585,860 | B2 * | 7/2003 | Ruf et al. | 162/198 |
| 6,779,377 | B2 * | 8/2004 | Schwarz | 73/1.02 |
| 6,805,772 | B2 * | 10/2004 | Schwarz | 162/198 |
| 2002/0060016 | A1 * | 5/2002 | Lumiala et al. | 162/190 |
| 2002/0060017 | A1 * | 5/2002 | Kuusisto et al. | 162/198 |
| 2002/0117282 | A1 * | 8/2002 | Ruf et al. | 162/198 |
| 2002/0179268 | A1 * | 12/2002 | Schwarz | 162/198 |
| 2003/0000669 | A1 * | 1/2003 | Strand et al. | 162/198 |
| 2003/0019274 | A1 * | 1/2003 | Schwarz | 73/1.02 |
| 2003/0089479 | A1 * | 5/2003 | Griech et al. | 162/263 |
| 2005/0082027 | A1 * | 4/2005 | Virtanen et al. | 162/198 |
| 2005/0173087 | A1 * | 8/2005 | Hietaniemi | 162/198 |
| 2005/0224204 | A1 * | 10/2005 | Hietaniemi | 162/198 |
| 2005/0279477 | A1 * | 12/2005 | Hietaniemi | 162/198 |
| 2007/0095495 | A1 * | 5/2007 | Reuter et al. | 162/258 |

FOREIGN PATENT DOCUMENTS

| | | | |
|---|---|---|---|
| EP | 1780333 | A2 * | 5/2007 |

* cited by examiner

METHOD AND APPARATUS FOR PRODUCING A FIBROUS WEB

BACKGROUND OF THE INVENTION

1. Field of the Invention

This invention relates to a method for producing a fibrous web, in particular a paper web, paperboard web or tissue web, with which a material flow of higher consistency and a material flow of lower consistency are divided among respectively shared sections over the machine width and the two material flows of each section then mixed in a variable ratio to each other and the respective mixed flow fed via a headbox as a headbox stream to a mesh section, whereby the mixing ratio between these two material flows of different consistency in the respective mixed flow acts as the set-point variable for control of the gsm (grams per square meter) substance of the fibrous web over the machine width (it is understood that the gsm of the fibrous web can be referred to as the gsm substance of the fibrous web).

2. Description of the Related Art

In a dilution headbox, two material flows of different consistency, referred to as thick material and thin material for example, are mixed in a ratio which is variable over the machine width. Usually mesh water is used as thin material. The mix passes into the mesh section via the headbox stream. The mixing ratio acts as the set-point variable for the sectional control of the gsm (grams per square meter) substance of the fibrous web over the machine width. Hence it is possible to establish a constant gsm substance in the transverse direction in spite of interference variables such as different shrinkage over the width in the drying section.

Using the composition of the thick and thin material it is also possible with the mixing ratio to vary the ratio of filler material to fibers in the suspension. Furthermore, a changed composition of the suspension stream leads to a change of fibrous material retention and filler material retention in the mesh section. Hence the control of the gsm substance also influences in general the fraction of filler material in the paper.

It would be desirable to have not only a constant gsm substance over the machine width but also a constant filler material fraction over the machine width. However, as only one set-point variable is available for these two controlled variables, the control solution used hitherto is unable in general to accomplish this.

The object of the present invention is to create a simple and cost-effective method, as well as an accordingly improved apparatus of the type initially referred to, with which the previously mentioned disadvantages are reduced or even eliminated. In particular an at least essentially constant filler material fraction of the fibrous web over the machine width is also to be assured in as simple and reliable a manner as possible.

SUMMARY OF THE INVENTION

With regard to the method, the object of the invention is accomplished according to the invention in that the ratio between the fibrous material content and the filler material content in the respective material flow of lower consistency is established or controlled prior to its division such that the filler material fraction in the fibrous web can be established or controlled at least essentially independently of the gsm substance.

Because the filler material fraction in the fibrous web can be established essentially independently of the gsm substance of the fibrous web, it is possible to establish not only a constant gsm substance over the width but also a filler material fraction of the fibrous web over the width that is essentially unaffected by the gsm substance control. With the corresponding establishment or control of the ratio between the fibrous material content and the filler material content in the material flow of lower consistency prior to its division, the influence of the gsm substance control on the local filler material content of the fibrous web is thus reduced to a minimum.

To change the ratio between the fibrous material content and the filler material content in the material flow of lower consistency it is possible, prior to its division into the various sections for example, for fibers or filler material to be added to said material flow or removed from it.

If the mean filler material content in the fibrous web over the machine width changes as the result, then it is advantageous for fibers or filler material to be added to or removed from the material flow of higher consistency, in particular prior to its division, in order to establish or control the mean filler material fraction in the fibrous web. However, it is also possible for mesh water or fresh water or clarified filtrate to be added to the material flow of higher consistency prior to its division.

Preferably the material flow of lower consistency is formed using mesh water and/or fresh water and/or clarified filtrate.

According to a preferred practical embodiment of the method of the invention the ratio between the fibrous material content and the filler material content in the material flow of lower consistency is continuously established or controlled accordingly. In this connection the addition or removal of the fibers or the filler material takes place continuously.

Advantageously an online control of the ratio between the fibrous material content and the filler material content in the material flow of lower consistency is possible.

According to a practical embodiment of the method of the invention the transverse profile of the filler material fraction in the fibrous web is determined and also used in establishing or controlling the ratio between the fibrous material content and the filler material content in the material flow of lower consistency. In this case it makes sense for the transverse profile of the fibrous material fraction in the fibrous web to be continuously determined during operation.

The method of the invention is particularly easy to apply if, for the purpose of establishing the ratio between the fibrous material content and the filler material content in the material suspension of lower consistency, the value of a set-point variable for controlling the transverse profile of the gsm substance of the fibrous web, such as the respective valve setting of the divided material flow of lower consistency for example, is compared with the respectively determined transverse profile of the filler material fraction in the fibrous web in order to identify whether a local increase or decrease of the dilution water fraction leads to a locally higher or lower filler material fraction respectively in the fibrous web.

In this case it is preferable for the local filler material fraction in the fibrous web to be compared with the corresponding local dilution water fraction in the material suspension, whereby it makes sense for the shrinkage of the fibrous web to be taken into account taken in this comparison.

In the event that a higher or lower dilution leads to a higher or lower filler material content of the fibrous web respectively, it is advantageous either for more fibers to be added to or filler material removed from or for more filler material to be added to or fibers removed from the material flow of lower consistency respectively prior to its division.

In concrete terms this means, for example, that in the case of an increase in dilution, which leads to a higher filler material content of the fibrous web, more fibers are added to or filler material removed from the material flow of lower consistency prior to its division.

If, on the other hand, a higher dilution leads to a lower filler material content of the fibrous web for example, then more filler material is added to or fibers removed from the material flow of lower consistency prior to its division.

Another embodiment of the inventive method provides for the establishment or control of the ratio between the fibrous material content and the filler material content in the material flow of lower consistency to be performed while taking account of the mass balance of the flows in the mesh section.

It is also an advantage for the establishment or control of the ratio between the fibrous material content and the filler material content in the material flow of lower consistency to be performed while taking account of the dependency of the fibrous material retention and the filler material retention on the composition of the mixed flow or headbox stream.

The filler material retention and/or the fibrous material retention can be determined in a previous test. Few tests are required for this as a rule.

With regard to the apparatus, the previously mentioned object of the invention is accomplished according to the invention in that the ratio between the fibrous material content and the filler material content in the material flow of lower consistency can be established or controlled prior to its division such that the filler material fraction in the fibrous web can be established or controlled at least essentially independently of the gsm substance.

Preferably a dilution water headbox is provided as headbox.

With a preferred practical embodiment of the apparatus of the invention the ratio between the fibrous material content and the filler material content in the material flow of lower consistency can be continuously established or controlled accordingly.

Advantageously the apparatus comprises means for continuously adding or removing fibers or filler material in order accordingly to establish or control the ratio between the fibrous material content and the filler material content in the material flow of lower consistency.

Preferably means are provided for the continuous measurement of the fibrous material fraction and/or the filler material fraction in the fibrous web and, expediently, also means for the continuous determination of the fibrous material retention and/or the filler material retention using the measured fibrous material fraction and/or filler material fraction.

There are also advantages to be gained in particular from an online control of the ratio between the fibrous material content and the filler material content in the material flow of lower consistency.

Preferably means are also provided for determining a filler material content transverse profile of the fibrous web. In this case the ratio between the fibrous material content and the filler material content in the material flow of lower consistency can be established or controlled expediently as a function of the determined filler material content transverse profile.

An apparatus for producing a fibrous material web has means for (which can also be referred to as "at least one device configured for") dividing a material flow of higher consistency and a material flow of lower consistency among respectively shared sections over the machine width and means for (which can also be referred to as "at least one device configured for") mixing the two material flows of different consistency in each section in a variable ratio, whereby the respective mixed flow can be fed via a headbox as a headbox stream to a mesh section, and has means for (which can also be referred to as "at least one device configured for") controlling the gsm (grams per square inch) substance of the fibrous web over the machine width using the mixing ratio between the two material flows as a set-point variable, wherein the ratio between the fibrous material content and the filler material content in the respective material flow of lower consistency can be at least one of established and controlled prior to its division such that the filler material fraction in the fibrous web can be established or controlled at least essentially independently of the gsm substance.

BRIEF DESCRIPTION OF THE DRAWINGS

The above-mentioned and other features and advantages of this invention, and the manner of attaining them, will become more apparent and the invention will be better understood by reference to the following description of (an) embodiment(s) of the invention taken in conjunction with the accompanying drawing(s), wherein.

Figure 1:
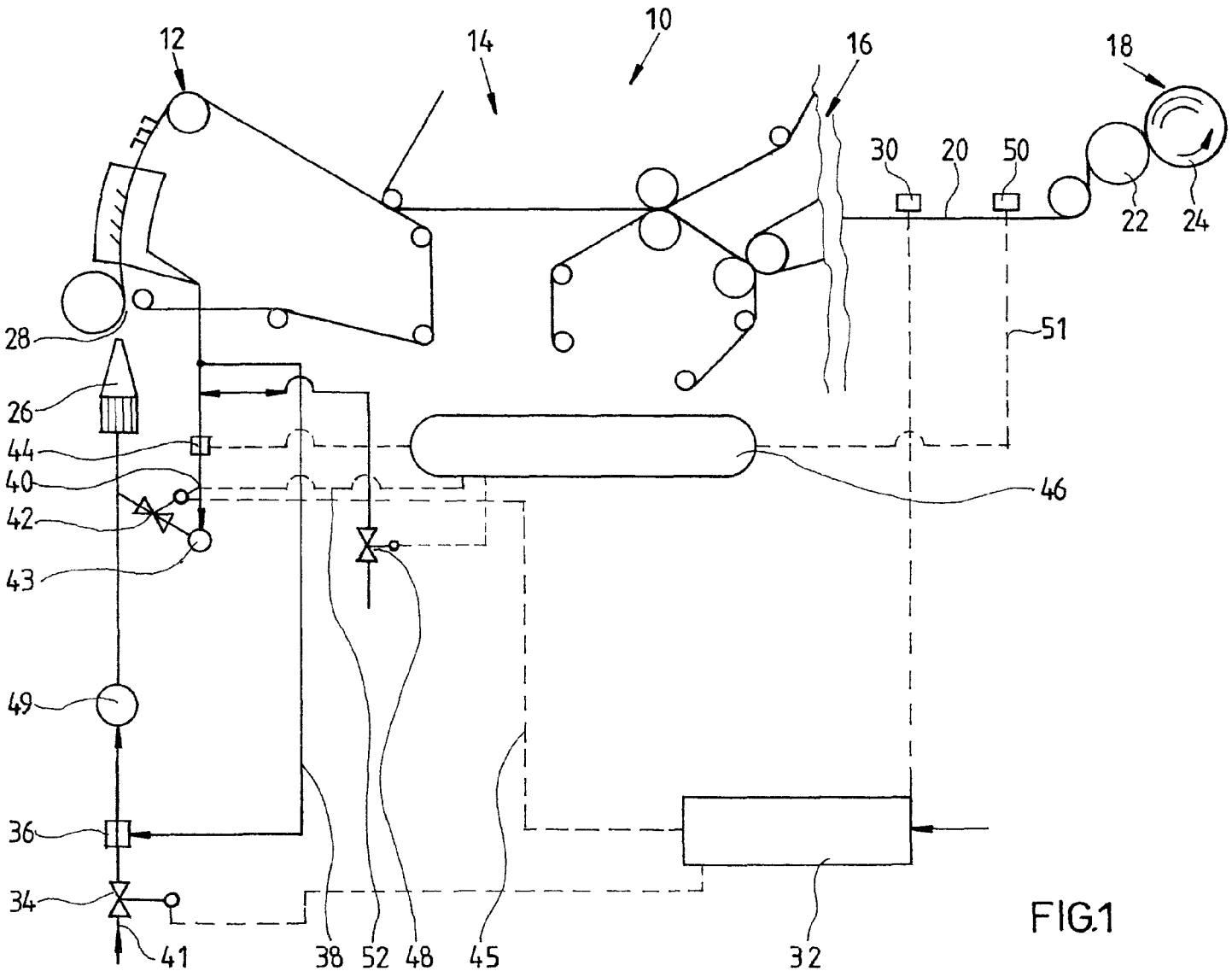
FIG. 1 is a schematic partial representation of an apparatus for producing a fibrous web.

Corresponding reference characters indicate corresponding parts throughout the several views. The exemplification(s) set out herein illustrate(s) (one) embodiment(s) of the invention (in one form) and such exemplification(s) (is)(are) not to be construed as limiting the scope of the invention in any manner.

DETAILED DESCRIPTION OF THE INVENTION

FIG. 1 shows, in a schematic partial representation, an apparatus 10 for producing a fibrous web, for example a paper web, paperboard web or tissue web. Hence the apparatus 10 can be in particular a paper machine.

The apparatus 10 or paper machine comprises a mesh section 12, a press section 14, a drying section 16 (not illustrated here) and a take-up unit 18 in which the fibrous web 20 is finally wound up into a coil 24 by means of a contact roller 22.

A material flow of higher consistency, i.e. with a higher solid content, and a material flow of lower consistency, i.e. with a lower solid content, are divided among respectively shared sections over the machine width. Then the material flows of each section are mixed together in a variable ratio. The mixed flow thus obtained over the machine width—from section to section over the machine width the mixed flow can have a different mixing ratio between the material flow of higher consistency and the material flow of lower consistency—is fed via a headbox 26, in this case a dilution water headbox for example, as a headbox stream or suspension stream 28 to the mesh section 12. The mixing ratio between the two material flows of different consistency acts as the set-point variable for control of the gsm substance of the fibrous web 20 across the width.

The gsm substance of the fibrous web 20 is measured usually in the region between the drying section 16 and the take-up unit 18 by means of an appropriate measuring instrument 30. In this case the measurement of the gsm substance is taken at various measuring points spread over the machine width.

The mean gsm substance of the fibrous web 20 is calculated from these measurements.

The actual value in question of the mean gsm substance is sent to a device 32 for controlling the material density and is compared there with a set-point value. In this case the set-point value can be supplied by a control and/or evaluation unit (not illustrated). The actual value of the mean gsm substance is adjusted to the set-point value by the corresponding control.

As is evident from FIG. 1, the control device 32 is used to actuate a material control valve 34 which is arranged in a line 41 conveying thick material to a mixing point 36. The mean gsm substance is thus established. Downstream from the mixing point 36 the thick material or material flow of higher consistency is fed to a transverse distribution device 49, by means of which the thick material is divided into several sections over the machine width.

According to the invention the ratio between the fibrous material content and the filler material content in the material flow of lower consistency is established or controlled prior to its division such that the filler material fraction in the fibrous web 20 can be established or controlled at least essentially independently of the gsm substance.

On the embodiment in question according to FIG. 1, provision is made for a line 40 conveying mesh water, by means of which dilution water or mesh water can be fed to the material flow coming from the mixing point 36. The line 40 uses a transverse distribution device 43—the material flow of lower consistency is divided in said distribution device among various sections over the machine width—to feed several valves 42 arranged side by side over the machine width, whereby each valve 42 in the machine width is assigned respectively to one section in which thick material is conveyed.

The valves 42 are connected via control lines 45 to the control device 32 of the gsm substance, which sends a control signal to each valve 42. The respective control signal, with account taken of the transverse profile of the gsm substance determined with the measuring instrument 30, is sent to the valve 42 of the corresponding section in the headbox 26, whereby the shrinkage of the fibrous web 20 is taken into account.

In this way it is possible for a mixed flow with a variable ratio between the material flow of higher consistency and the material flow of lower consistency to be produced in each section.

The local gsm substance is established through establishment of the local rate of material flow of lower consistency, the so-called dilution water rate.

A measuring instrument 44 is used to measure the filler material content or ash content as well as the fiber concentration of the mesh water conveyed in the line 40. The actual values are sent to a control device 46 which compares the actual values in question with set-point values supplied again by the control and/or evaluation unit for example and actuates a respective valve 48 accordingly in order to add more filler material or fibers to the material flow of lower consistency prior to its division in the transverse distributor 43.

Also, provision is made for a measuring instrument 50 by means of which the transverse profile of the filler material content of the fibrous web 20 in the region between the drying section 16 and the take-up unit 18 is measured.

The filler material content measured by the measuring instrument 50 is sent over a line 51 to the control device 46. In practice the measuring instruments 30 and 50 are usually constructed as one unit.

Furthermore, according to a preferred embodiment of the invention the position of the valves 42 is sent over a line 52 to the control device 46. Alternatively it is also conceivable for the control device 46 to receive a corresponding signal directly from the control device 32.

The establishment of the ratio between the fibrous material content and the filler material content in the material suspension of lower consistency by the control device 46 then takes place with account taken of the comparison drawn between the determined transverse profile of the filler material fraction in the fibrous web 20 and the set-point variable for control of the transverse profile of the gsm substance of the fibrous web 20, here in the form of the position of the valves 42. Through the comparison it is possible to determine whether a local increase or decrease of the gsm substance leads to a locally bigger or smaller filler material fraction in the fibrous web 20.

In the comparison it is possible in addition to take account of the mean values of the set-point variable and the filler material fraction determined over the machine width, thus resulting in the following correlation for example:

$$K \approx \int (\hat{A}(y) - A) * (\hat{x}(y) - x) dy$$

whereby the integral is applied over the machine width and $\hat{x}(y)$ is the set-point value of a valve 42 assigned to a certain section and $\hat{A}(y)$ the filler material fraction in the fibrous web 20 of the section in question, whereby the shrinkage of the fibrous web is taken into account. The variables A and x are the mean values of the filler material fraction and the set-point value respectively determined over the machine width.

Figure 10:
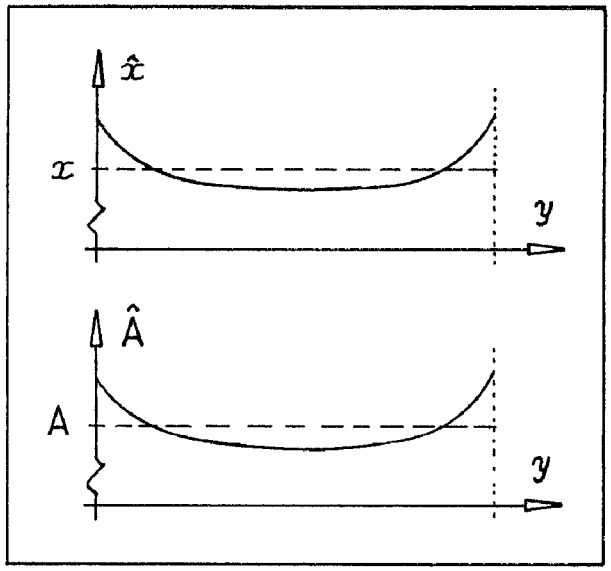
FIG. 10 is a diagram regarding the correlation between the filler material content and the dilution water addition.
Figure 11:
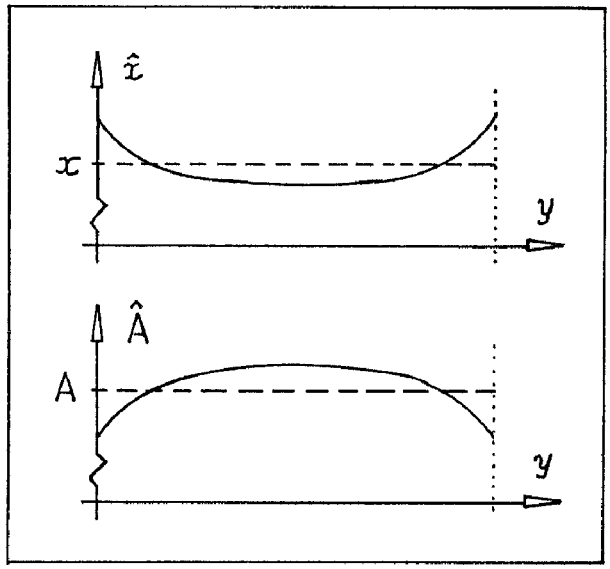
FIG. 11 is another diagram regarding the correlation between the filler material content and the dilution water addition.

Evident in the FIGS. 10 and 11 are possible different correlations between the filler material fraction and the addition of the material flow of lower consistency.

With the correlation presented in FIG. 10 the result is a correlation value of $K>0$, which means that a local increase of the material flow of lower consistency—here in both edge regions—leads to a local increase of the filler material fraction in the fibrous web 20. In this case, through the control device 46 the ratio between the filler material content and the fibrous material content in the material flow of lower consistency is established prior to its division such that the filler material fraction in the fibrous web 20 is essentially unaffected by a local addition of dilution water or material flow of lower consistency.

In the case of $K>0$, meaning a higher dilution leads to a higher filler material content of the fibrous web 20, more fibers can be added to or filler material removed from the material flow of lower consistency.

With the correlation presented in FIG. 11 the result is a correlation value of K<0, which means that a local increase of the material flow of lower consistency—here in both edge regions—leads to a local decrease of the filler material fraction in the fibrous web 20. In this case, through the control device 46 the ratio between the filler material content and the fibrous material content in the material flow of lower consistency is established prior to its division such that the filler material fraction in the fibrous web 20 is essentially unaffected by a local addition of dilution water or material flow of lower consistency.

In the case of K<0, meaning a higher dilution leads to a smaller filler material fraction of the fibrous web 20, more filler material can be added to or fibers removed from the material flow of lower consistency.

Alternatively, the establishment or control of the ratio between the fibrous material content and the filler material content in the material flow of lower consistency can be performed while taking account of the mass balance of the flows in the mesh section and while taking account of the dependency of the fibrous material retention and the filler material retention on the composition of the mixed flow or headbox stream.

Using the control devices in question it is possible for the ratio between the fibrous material content and the filler material content in the material flow of lower consistency to be continuously established or controlled. As previously explained, fibers or filler material are continuously added or removed for example in order to establish or control accordingly the ratio between the fibrous material content and the filler material content in the material flow of lower consistency.

To control the gsm substance the gsm substance is measured preferably continuously. Similarly, the fibrous material retention can be determined continuously during operation by continuous measurement of the fibrous material content in the fibrous web.

The filler material retention can be determined in a few previous tests. However, this filler material retention is also preferably determined continuously during operation by means of a continuous measurement of the filler material content in the fibrous web 20 by means of the measuring instrument 50 for example.

In particular an online control of the ratio between the fibrous material content and the filler material content in the material flow of lower consistency is possible. Hence if the ratio of the fibrous material content to the filler material content of the dilution water satisfies a certain condition, then the filler material fraction in the fibrous web 20, in this case paper for example, can be established approximately independently of the gsm substance control. The condition is derived from a mass balance of the flows in the mesh section 12 and from a knowledge of the dependency of the fiber retention and the filler material retention on the composition of the suspension stream 28 at a given working point.

According to the invention the composition of the dilution water is adjusted accordingly to the stipulated condition. If mesh water is to be used as dilution water as hitherto, then fibers or filler material must be added to or removed from it continuously depending on the characteristics of the mesh section 12 in question.

To determine the optimum composition it is necessary to know the retentions at the working point and their dependence on the composition of the suspension. In the simplest case the retentions can be determined once in a test. Should they vary too much during operation, then it is also possible to install an online control. The continuous measurement of the filler material content in the paper web in transverse direction is required for such an online control. A possible need to adjust the composition of the dilution water is indicated by a comparison of the filler material transverse profile with the position profile of the headbox valves, whereby the shrinkage of the web must be taken into account when drawing this comparison. If the locally higher dilution then leads to a higher filler material content, then either more fibers must be added to or more filler material removed from the dilution water.

The effect achieved with the method of the invention and with the apparatus of the invention becomes evident from a comparison of the following three cases for example:

1st Case:

The ratio of filler material to fibers in the dilution water is too high. A local dilution increases the filler material fraction in the suspension stream greatly. The filler material retention decreases more than the fibrous material retention, but the filler material retention in the paper still remains too high locally.

2nd Case:

The ratio of filler material to fibers in the dilution water is too low. With local dilution in the suspension stream the filler material fraction is insufficient for compensating the locally even lower filler material retention. Too little filler material remains in the paper locally.

3rd Case:

The ratio of filler material to fibers in the dilution water meets the requirement. With local dilution the ratio of filler material to fibers in the suspension stream is initially higher than the mean over the machine width. However, as the result of the locally lower ratio of filler material retention to fibrous material retention, of which the former decreases more than the latter, the correct quantity of filler material again arrives in the paper.

Where talk here is of filler material, this also covers the possible use of different filler material types.

With regard to the mesh water line, the following four possibilities arise with respect to the feed and/or draw-off points in question:

Adding or removing filler material or ash.

Adding or removing fibers.

Also conceivable in this case is in particular a selective measurement of the filler material concentration in the mesh water line.

Corresponding constellations are possible for the thick material stream.

Figure 9:
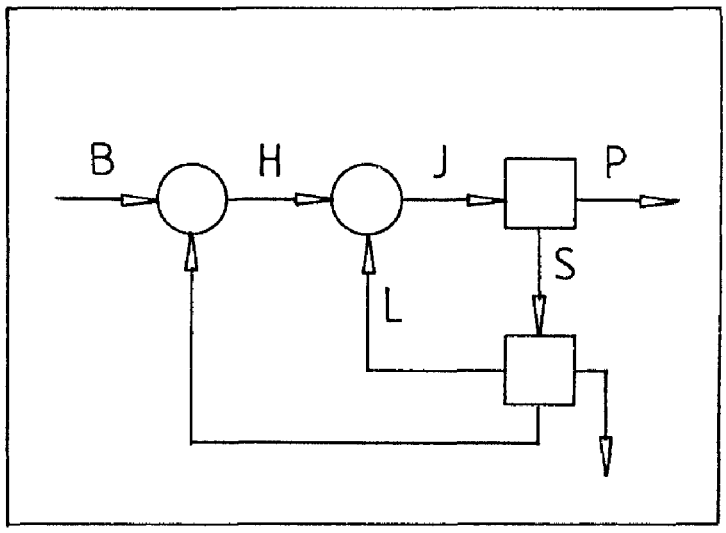
FIG. 9 is a diagram of the mass balance of the headbox and the mesh section.

FIG. 9 shows a diagram of the mass balance of the headbox and the mesh section.

The following terms are used in this diagram and in the explanation below:

Symbols:

| | | |
|---|---|---|
| c | $kg/m^3$ | material density |
| $\dot{m}$ | kg/(m s) | mass flow |
| q | $m^3/(m\ s)$ | volumetric flow |
| R | kg/kg | retention |

Indices

| | |
|---|---|
| A | ash |
| B | vat |
| F | fibers |
| J | stream |
| L | low consistency |
| H | high consistency |
| P | entry to press |
| S | mesh water |

Wildcards $i \in \{F,A\}$ $j \in \{B,L,H,J,P,S\}$

Flows

1. Volumetric Flows

The stream results from a mix of a fraction of low consistency and a fraction of high consistency:

$$q_L + q_H = q_J$$

$$x := \frac{q_L}{q_J}.$$

2. Mass Flows

The mass flows can be expressed as products of the consistencies with the respective volumetric flow:

$$\dot{m}_{i,j} = c_{i,j} q_j.$$

The total mass flow (of the solids) consists of a fiber fraction and an ash fraction:

$$\dot{m}_{F,j} + \dot{m}_{A,j} = \dot{m}_j.$$

Mass conservation means that $$\dot{m}_{i,L} + \dot{m}_{i,H} = \dot{m}_{i,j}.$$

Retention

The retentions are defined as quotients of the mass flows downstream and upstream from the mesh section:

$$R := \frac{\dot{m}_P}{\dot{m}_J},\ R_i := \frac{\dot{m}_{i,P}}{\dot{m}_{i,J}}.$$

Local Variation of x

Using the valves of a dilution headbox, in this case a ModuleJet headbox for example, it is possible to vary locally the feeding of dilution water ( ):

$$\hat{x} := \frac{\hat{q}_L}{\hat{q}_J}.$$

This variation also affects the local retentions:

$$\hat{R} := \frac{\hat{\dot{m}}_P}{\hat{\dot{m}}_J},\ \hat{R}_i := \frac{\hat{\dot{m}}_{i,P}}{\hat{\dot{m}}_{i,J}}.$$

Assuming that its change is owed primarily to a change of the local material density, then the following can be written:

$$\hat{R}_i = R_i + \left.\frac{\partial \hat{R}_i}{\partial \hat{c}_J}\right|_{\hat{c}_J = c_J} (\hat{c}_J - c_J) + \dots .$$

The ModuleJet headbox is designed such that a local variation of the mesh water fraction causes practically no change to the local total volumetric flow:

$$\hat{q}_L + \hat{q}_H = \hat{q}_J = q_J.$$

If it is assumed that small local changes have no noteworthy effect on the material densities $c_{i,L}$ and $c_{i,H}$, then the local mass flows in the stream are $$\hat{\dot{m}}_{i,J} = \hat{c}_{i,j}\hat{q}_J = c_{i,L}\hat{q}_L + c_{i,H}(q_J - \hat{q}_L) = [c_{i,L}\hat{x} + c_{i,H}(1-\hat{x})]q_J$$

and downstream from the mesh section $$\hat{\dot{m}}_{i,P} = \hat{R}_i \hat{\dot{m}}_{i,j} = \hat{R}_i[c_{i,L}\hat{x} + c_{i,H}(1-\hat{x})]q_J.$$

Hence the local total mass flow downstream from the mesh section is $$\hat{\dot{m}} = \sum_i \hat{\dot{m}}_{i,P}$$

$$= \{\hat{R}_F[c_{F,L}\hat{x} + c_{F,H}(1-\hat{x})] + \hat{R}_A[c_{A,L}\hat{x} + c_{A,H}(1-\hat{x})]\}q_J$$

or with the approximation $c_{F,L} \approx 0$ $$\hat{\dot{m}}_P \approx \{\hat{R}_F c_{F,H}(1-\hat{x}) + \hat{R}_A[c_{A,L}\hat{x} + c_{A,H}(1-\hat{x})]\}q_J.$$

The local ash fraction is $$\hat{A} := \frac{\hat{\dot{m}}_{A,P}}{\hat{\dot{m}}_P}$$

$$= \frac{\hat{R}_A[c_{A,L}\hat{x} + c_{A,H}(1-\hat{x})]}{\hat{R}_F[c_{F,L}\hat{x} + c_{F,H}(1-\hat{x})] + \hat{R}_A[c_{A,L}\hat{x} + c_{A,H}(1-\hat{x})]}$$

$$\approx \frac{\hat{R}_A[c_{A,L}\hat{x} + c_{A,H}(1-\hat{x})]}{\hat{R}_F c_{F,H}(1-\hat{x}) + \hat{R}_A[c_{A,L}\hat{x} + c_{A,H}(1-\hat{x})]}.$$

Sensitivities

Given a local change of the feeding of dilution water, both the local gsm substance, which is proportional to $\hat{\dot{m}}_P$, and the local ash fraction $\hat{A}$ change. The two (standardized) sensitivities to $\hat{x}$, i.e. $(1/\hat{A}_P)(\partial\hat{A}_P/\partial\hat{x})$ and $(1/\dot{m}_P)(\partial\dot{m}_P/\partial\hat{x})$, depend on the mean global dilution water fraction x.

The question arises as to whether a highest possible sensitivity of the gsm substance on the one hand and a lowest possible sensitivity of the ash fraction on the other hand to $\hat{x}$ are attainable through the suitable choice of a certain operating point x. Considering in this connection the quotient of the standardized sensitivities (for simplification of the equation at the point $\hat{x}=x$)

$$\left.\frac{\frac{1}{\hat{A}_P}\frac{\partial \hat{A}_P}{\partial \hat{x}}}{\frac{1}{\hat{m}_P}\frac{\partial \dot{m}_P}{\partial \hat{x}}}\right|_{\hat{x}=x} = \frac{Z}{N}$$

with $$Z = -\dot{m}_{F,P}\dot{m}_{A,P}\left(\frac{\dot{m}_{F,P}}{R_F} + \frac{\dot{m}_{A,P}}{R_A} - c_L q_J\right)\left(\frac{1}{R_F}\frac{\partial \hat{R}_F}{\partial \hat{c}_J}\bigg|_{\hat{c}_J=c_J} - \frac{1}{R_A}\frac{\partial \hat{R}_A}{\partial \hat{c}_J}\bigg|_{\hat{c}_J=c_J}\right) + (R_A c_{A,L}\dot{m}_{F,P} - R_F c_{F,L}\dot{m}_{A,P})q_J^2$$

$$N = \dot{m}_{A,P}\left\{\begin{array}{c}\left(\frac{\dot{m}_{F,P}}{R_F} + \frac{\dot{m}_{A,P}}{R_A} - c_L q_J\right)\\ \left(\frac{\dot{m}_{F,P}}{R_F}\frac{\partial \hat{R}_F}{\partial \hat{c}_J}\bigg|_{\hat{c}_J=c_J} + \frac{\dot{m}_{A,P}}{R_A}\frac{\partial \hat{R}_A}{\partial \hat{c}_J}\bigg|_{\hat{c}_J=c_J}\right) + \\ [\dot{m}_P - (R_F c_{F,L} + R_A c_{A,L})q_J]q_J\end{array}\right\}.$$

then it is evident that this quotient does not depend on x. Hence given a control of the gsm substance transverse profile with the help of the ModuleJet valves, the ash transverse profile is affected independently of the mean addition of dilution water.

However, the above equation also shows that a reduction of the ratio of the two sensitivities is attainable given a suitable setting of other variables. If, for example, the retentions and their dependencies on the material density are known, then it is possible to determine a matching $c_{F,L}$ from the equation $Z=0$ and a given $c_{A,L}$. With the values $\dot{m}_P$=54 kg/(m min)
A=0.3
$q_J$=7400 l/(m min)
x=0.15
$c_{A,L}$=4 g/l
RF=0.65+0.016$\Delta c_J$/(g/l)
RA=0.35+0.019$\Delta c_J$/(g/l)

then $c_{F,L}$=3.5 g/l, $c_{F,H}$=8.6 g/l and $c_{A,H}$=6.7 g/l for example.

The control of a dilution headbox affects in general both the gsm substance and the filler material fraction in the paper. Given a suitable composition of the dilution water it is possible, however, to minimize the effect on the filler material fraction according to the invention. This is demonstrated below in an example using a simplified model for the retentions:

Machine Data

The calculation assumes the following machine data:

| | |
|---|---|
| dry content at the roller | T = 0.91 |
| machine speed | v = 1080 m/min |
| (target) gsm substance | F = 55 g/m$^2$ |
| (target) filler material in paper | A = 30% |
| volumetric flow of stream | $q_J$ = 7400 l/(m/min) |
| mean dilution water fraction | x = 0.15 |
| local retention of fibers | $\hat{R}_F$ = 0.65 + 0.016$\Delta c_J$(g/l) |
| local retention of filler material | $\hat{R}_A$ = 0.35 + 0.019$\Delta c_J$(g/l) |

The two models for the local fiber retention $\hat{R}_F$ and the local filler material retention $\hat{R}_A$ assume that the local retentions for fibers and filler materials can be described approximately as linear functions of the local material density. In this case the filler materials react more sensitively to the variations than the fibers.

Variation of the Filler Material Fraction of the Dilution Water

Figure 2:
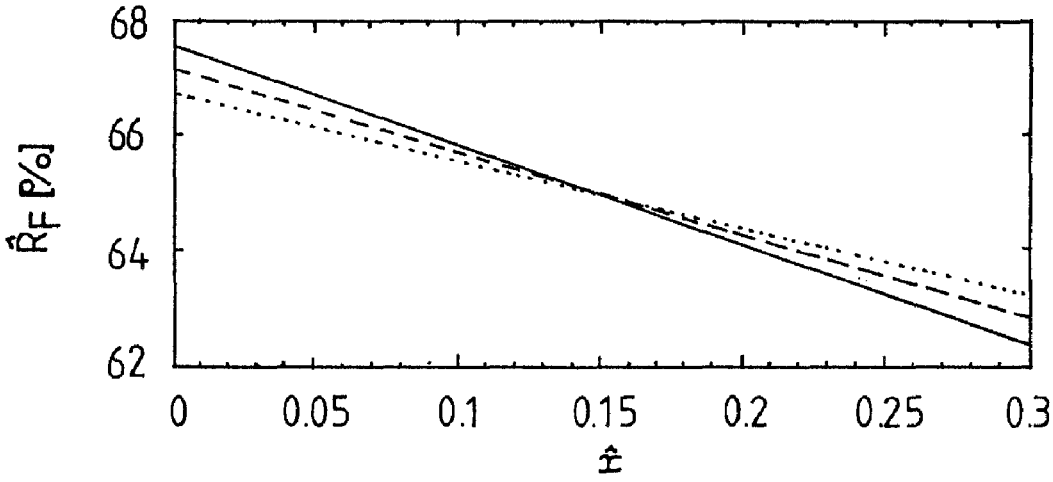
FIG. 2 is a diagram showing the dependence of the local fiber retention on the local dilution water fraction.

In the first example the fibrous material density of the dilution water is held at the constant value of $c_{F,L}$=2.8 g/l. The filler material fraction $c_{A,L}$ is varied at three levels of 2.2, 3.7 and 5.2 g/l. The required fibrous material density of the thick material results at $c_{F,H}$≈8.76 g/l. Its filler material content $c_{A,H}$ must be adjusted to 6.98, 6.71 and 6.45 g/l. The following diagrams contain the different curve types for the values of the filler material fraction $c_{A,L}$ according to — 2.2 g/l
- - - 3-7 g/l
. . . 5.2 g/l The diagram according to FIG. 2 shows the dependency of the local fiber retention on the local dilution water fraction $\hat{R}_F$. In the diagram according to FIG. 3 the dependency of the local filler material retention $\hat{R}_A$ on the local dilution water fraction $\hat{x}$ is shown.

Figure 3:
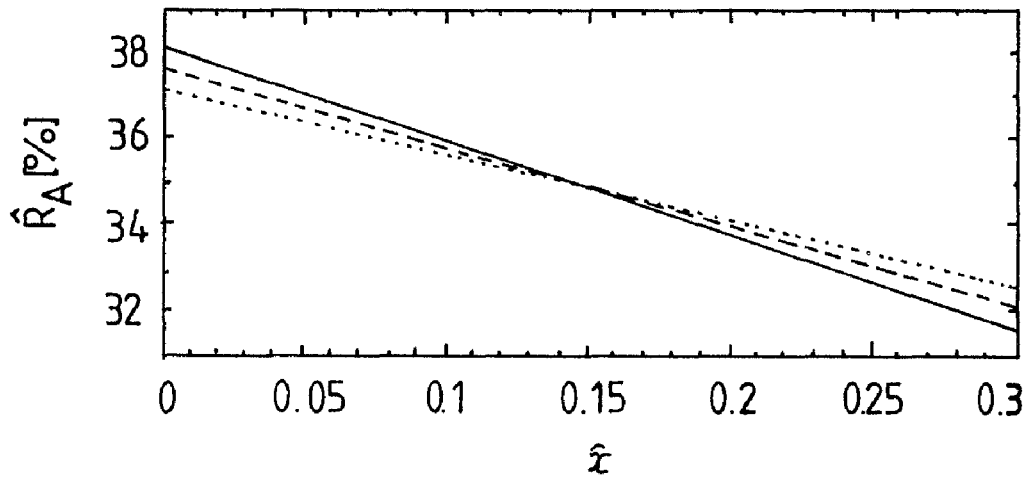
FIG. 3 is a diagram showing the dependence of the local filler material retention on the local dilution water fraction.

From the diagrams according to FIGS. 2 and 3 it is evident that with a higher filler material content of the dilution water the dilution water fraction affects the material density and hence the retention rather less.

Figure 4:
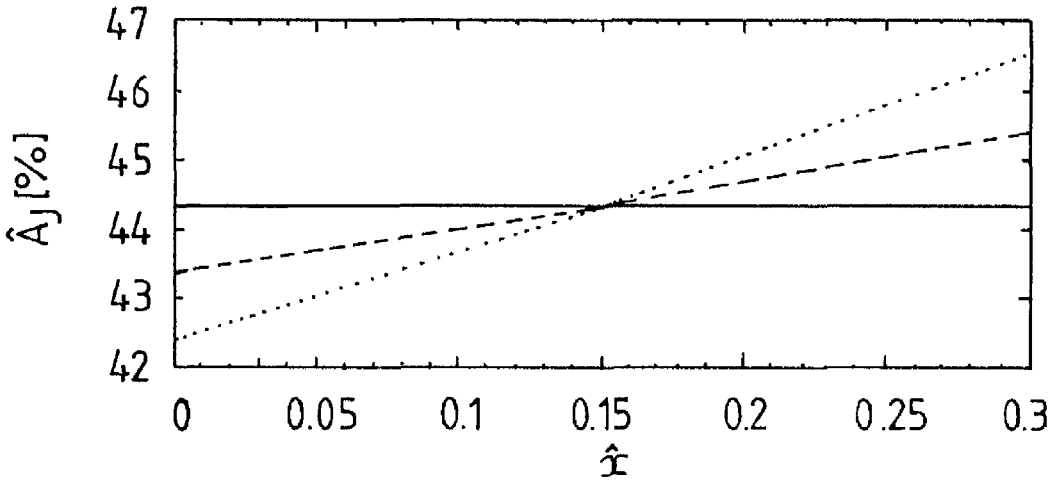
FIG. 4 is a diagram showing the dependence of the filler material fraction in the suspension stream on the local dilution water fraction.

The diagram according to FIG. 4 shows the dependency of the filler material fraction $\hat{A}_J$ on the local dilution water fraction $\hat{x}$. From this diagram according to FIG. 4 it is evident that for the lowest value of the filler material content of the dilution water the quotients $c_{A,L}/c_L$ and $c_{A,H}/c_H$ are approximately identical. Hence the relative filler material fraction in the suspension stream remains nearly unchanged during the variation of the local dilution water fraction $\hat{x}$. With a higher $c_{A,L}$ the filler material fraction $\hat{A}_J$ increases along with the local dilution water fraction $\hat{x}$.

Figure 5:
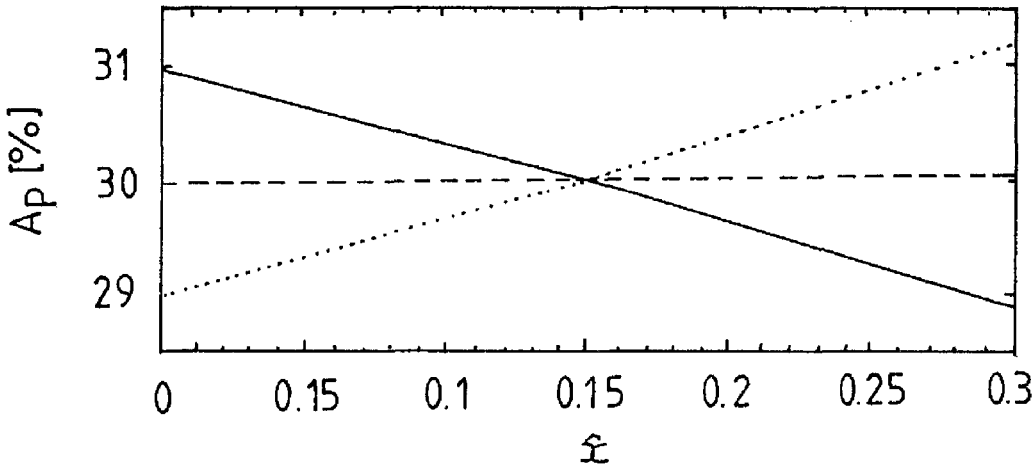
FIG. 5 is a diagram showing the dependence of the filler material fraction in the paper on the local dilution water fraction.

The diagram according to FIG. 5 shows the dependency of the filler material fraction $\hat{A}_P$ in the paper on the local dilution water fraction $\hat{x}$. With the lowest filler material content of the dilution water, a higher feeding rate of the dilution water does not lead to a change of the filler material fraction in the stream (cf. FIG. 4) but it does lead to an excessive decrease of the filler material retention (cf. FIGS. 2 and 3). Consequently, the relative filler material fraction in the paper decreases. With the highest filler material content of the dilution water the filler material retention also decreases, but this effect is more than compensated by the distinctly bigger filler material fraction in the suspension stream. The mean value for $c_{A,L}$ lies near the sought optimum at which the filler material fraction $\hat{A}_P$ is largely independent of the gsm substance control and thus constant.

Figure 6:
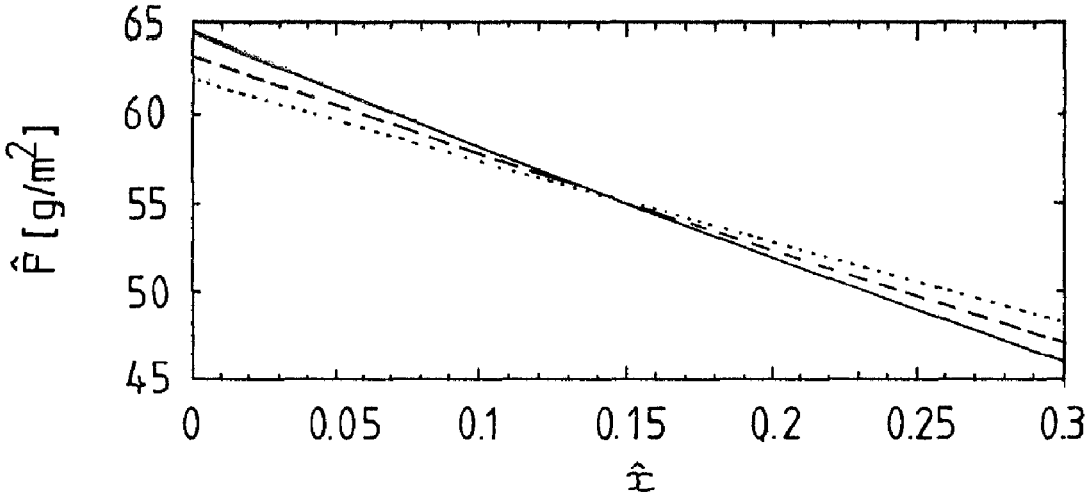
FIG. 6 is a diagram showing the dependence of the local gsm substance on the local dilution water fraction.

The diagram according to FIG. 6 shows the dependency of the local gsm substance $\hat{F}$ on the local dilution water fraction $\hat{x}$. The important point is that with a bigger filler material fraction of the dilution water the effect of the dilution water fraction on the gsm substance is somewhat smaller but the local gsm substance $\hat{F}$ can be controlled by way of the local dilution water fraction $\hat{x}$ for all the example values of $c_{A,L}$.

Variation of the Filler Material Density of the Dilution Water

Another calculation is carried out below with the same data as in the above example, but with the three values 2.0, 3.5 and 5.0 g/l for $c_{F,L}$ and $c_{A,L}$=4.0 g/l=const. The material densities of the thick material are $c_{F,H}$≈8.90, 8.64 and 8.37 g/l and $c_{A,H}$≈6.66 g/l. The curve types correspond in each case to the following values of $c_{F,L}$:

— 2.0 g/l

- - - 3.5 g/l

. . . 5.0 g/l.

Figure 7:
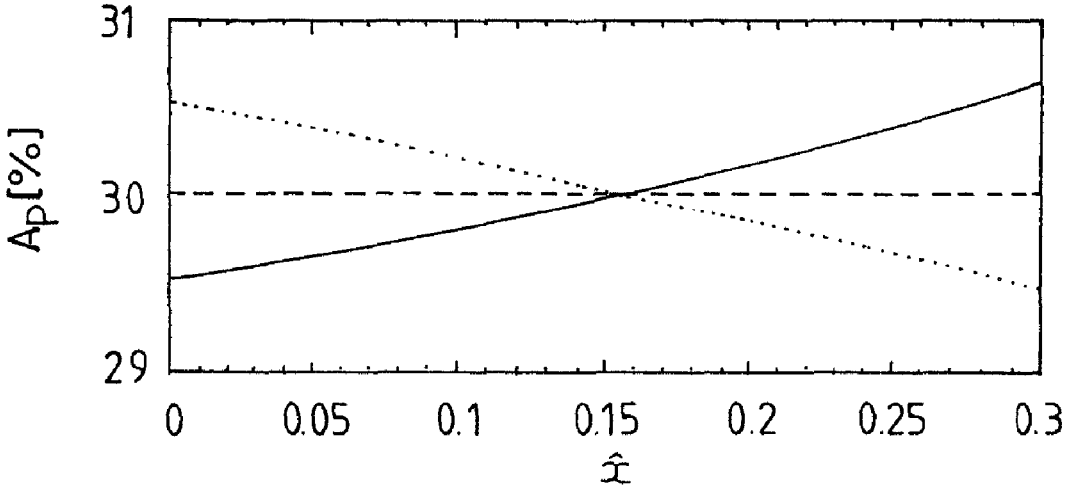
FIG. 7 is a diagram showing the dependence of the filler material fraction in the paper on the local dilution water fraction.

The diagram according to FIG. 7 shows the dependency of the filler material fraction $\hat{A}_P$ in the paper on the local dilution water fraction $\hat{x}$. Even with a variation $c_{F,L}$ it is again possible to adjust the dilution water such that the filler material fraction in the paper remains unaffected by the control. If too much fiber is added to the dilution water, then $\hat{A}_P$ decreases with $\hat{x}$. In the case of too little fiber, the effect is reversed.

Figure 8:
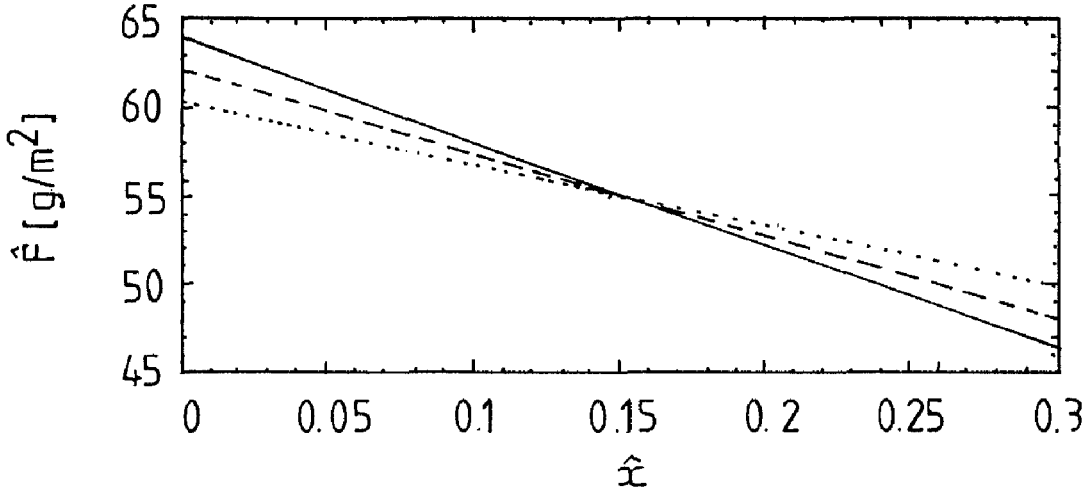
FIG. 8 is a diagram showing the dependence of the local gsm substance on the local dilution water fraction.

The diagram according to FIG. 8 shows the dependency of the local gsm substance $\hat{F}$ on the local dilution water fraction $\hat{x}$. In each case the gsm substance can be influenced as desired.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE NUMERALS

10 Apparatus
12 Mesh section
14 Press section
16 Drying section
18 Take-up unit
20 Fibrous web
22 Contact roller
26 Dilution headbox
28 Headbox stream, suspension stream
30 Measuring instrument for gsm substance
32 Device for controlling the material density
34 Valve
36 Mixing point
38 Line
40 Line
42 A valve of the row of valves extending over the machine width
44 Instrument for measuring the filler material content and the fiber concentration
46 Control device for controlling the filler material concentration and fiber concentration
48 Valve
50 Instrument for measuring the filler material transverse profile While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for producing a fibrous web, with which a material flow of higher consistency and a material flow of lower consistency are divided among respectively shared sections over the machine width and the material flows of each section then mixed in a variable ratio to each other and the respective mixed flow fed via a headbox as a headbox stream to a mesh section, whereby the mixing ratio between these two material flows of different consistency in the respective mixed flow acts as the set-point variable for controlling the transverse profile of the gsm (grams per square meter) of the fibrous web, wherein the ratio between a fibrous material content and a filler material content in the material flow of lower consistency is at least one of controllably established and controlled prior to its division by at least one of adding and removing one of fibrous material and filler material from the material flow of lower consistency such that the filler material fraction in the fibrous web can be established or controlled at least essentially independently of the gsm.

2. A method according to claim 1, wherein the ratio between the fibrous material content and the filler material content in the material flow of lower consistency is at least one of continuously established and controlled accordingly.

3. A method according to claim 1, wherein in order to at least one of establish and control the ratio between the fibrous material content and the filler material content in the material flow, lower consistency fibers or filler material are at least one of added to and removed from said material flow.

4. A method according to claim 1, wherein at least one of fibers and filler material are at least one of added to and removed from the material flow of higher consistency in order to establish or control the mean filler material fraction in the fibrous web over the machine width.

5. A method according to claim 1, wherein the material flow of lower consistency is formed using mesh water.

6. A method according to claim 1, wherein an online control of the ratio between the fibrous material content and the filler material content in the material flow of lower consistency is provided.

7. A method according to claim 1, wherein the transverse profile of the filler material fraction in the fibrous web is determined and the determined transverse profile used in at least one of establishing and controlling the ratio between the fibrous material content and the filler material content in the material flow of lower consistency.

8. A method according to claim 7, wherein the fibrous material fraction in the fibrous web is continuously determined during operation.

9. A method according to claim 7, wherein for the purpose of establishing the ratio between the fibrous material content and the filler material content in the material suspension of lower consistency the value of a set-point variable for controlling the transverse profile of the gsm (grams per square meter) of the fibrous web is compared with the determined transverse profile of the filler material fraction in the fibrous web in order to identify whether a local increase or decrease of the gsm leads to a locally higher or lower filler material fraction in the fibrous web.

10. A method according to claim 9, wherein the set-point variable comprises the position of the valve with which the material flow of lower consistency for forming the mixed flow is added.

11. A method according to claim 10, wherein in the event of one of a higher and lower dilution leading to one of a bigger and smaller filler material fraction in the fibrous web, either more fibers are added to or filler material removed from or more filler material is added to or fibers removed from the material flow of lower consistency.

12. A method according to claim 9, wherein the shrinkage of the fibrous web is taken into account in the comparison.

13. A method according to claim 1, wherein the establishment or control of the ratio between the fibrous material content and the filler material content in the material flow of lower consistency is performed while taking account of the mass balance of the flows in the mesh section.

14. A method according to claim 1, wherein the establishment or control of the ratio between the fibrous material content and the filler material content in the material flow of lower consistency is performed while taking account of the dependency of the fibrous material retention and the filler material retention in the fibrous web on the composition of the mixed flow or headbox stream at a preselectable working point.

15. A method according to claim 14, wherein, at least one of the filler material retention and the fibrous material retention is determined in a previous test.

16. A method according to claim 14, wherein the filler material retention is continuously determined during operation by way of a continuous measurement of the filler material fraction in the fibrous web.

* * * * *

UNITED STATES PATENT AND TRADEMARK OFFICE

CERTIFICATE OF CORRECTION

PATENT NO. : 7,763,148 B2
APPLICATION NO. : 11/553636
DATED : July 27, 2010
INVENTOR(S) : Jörg Reuter et al.

It is certified that error appears in the above-identified patent and that said Letters Patent is hereby corrected as shown below:

COLUMN 12

At line 21, please delete "3-7 g/l", and substitute therefore --3.7 g/l--.

Signed and Sealed this
Eleventh Day of October, 2011

David J. Kappos

David J. Kappos
*Director of the United States Patent and Trademark Office*